US011364396B2

(12) United States Patent
Gong et al.

(10) Patent No.: US 11,364,396 B2
(45) **Date of Patent: *Jun. 21, 2022**

(54) PPE WITH ROTATING ASSEMBLY PROVIDING MULTIPLE FACE COVERS

(71) Applicant: GOLDEN GALAXY CORPORATION, Henderson, NV (US)

(72) Inventors: Kevin Gong, Annendale, VA (US); Yisha Tang, Shenzhen (CN); Ouyang Wenyi, Shenzhen (CN); Dai Chiuyin, Shenzhen (CN); Allen Bryan, Redwood City, CA (US)

(73) Assignee: GOLDEN GALAXY CORPORATION, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/577,200

(22) Filed: Jan. 17, 2022

(65) Prior Publication Data

US 2022/0134140 A1 May 5, 2022

Related U.S. Application Data

(63) Continuation-in-part of application No. 17/352,340, filed on Jun. 20, 2021, now Pat. No. 11,259,578, (Continued)

(51) Int. Cl.
*A62B 18/02* (2006.01)
*A62B 23/02* (2006.01)
(Continued)

(52) U.S. Cl.
CPC ..... *A62B 18/02* (2013.01); *A41D 13/002* (2013.01); *A41D 13/02* (2013.01);
(Continued)

(58) Field of Classification Search
CPC ..... A62B 18/00; A62B 18/04; A62B 18/045; A62B 17/001; A62B 17/006; A62B 18/08;
(Continued)

(56) References Cited

U.S. PATENT DOCUMENTS 622,677 A * 4/1899 Gallagher ..... A62B 17/04 2/5
3,221,339 A * 12/1965 Correale, Jr. ..... B64D 10/00 2/6.2

(Continued)

*Primary Examiner* — Tu A Vo
(74) *Attorney, Agent, or Firm* — Stephen E. Zweig

(57) ABSTRACT

A personal protective device (PPE) including a face cover assembly and a bodysuit configured to be worn by a human user. The device protects users against airborne aerosol particles containing viruses or other infectious agents while enabling improved flexibility relative to prior art designs. The device includes a helmet-like" rotating face cover assembly that fits over the user's head and attaches to a collar on the biohazard bodysuit. This rotating face cover assembly has a plurality of different mask sides, each with differing geometries or other properties. The device enables a user to rotate (either manually or by electric motor) the masks and select a given mask side that best meets that user's needs. The different mask sides can accommodate different facial geometries, eyewear types, and use cases, such as operation in more hostile environments.

17 Claims, 7 Drawing Sheets

Related U.S. Application Data which is a continuation-in-part of application No. 17/093,213, filed on Nov. 9, 2020, now Pat. No. 11,065,480.

(51) Int. Cl.

| | |
|---|---|
| ***A62B 17/00*** | (2006.01) |
| ***A62B 18/08*** | (2006.01) |
| ***A62B 18/04*** | (2006.01) |
| ***A62B 17/04*** | (2006.01) |
| ***A41D 13/02*** | (2006.01) |
| ***A41D 13/11*** | (2006.01) |
| ***A41D 31/30*** | (2019.01) |
| ***A41D 13/002*** | (2006.01) |
| ***A41D 27/28*** | (2006.01) |
| ***A62B 7/02*** | (2006.01) |
| ***A62B 18/10*** | (2006.01) |

(52) U.S. Cl.

CPC ..... *A41D 13/1153* (2013.01); *A41D 13/1184* (2013.01); *A41D 27/28* (2013.01); *A41D 31/30* (2019.02); *A62B 7/02* (2013.01); *A62B 17/006* (2013.01); *A62B 18/04* (2013.01); *A62B 18/08* (2013.01); *A62B 18/10* (2013.01); *A62B 23/02* (2013.01); *A41D 2300/32* (2013.01); *A41D 2300/322* (2013.01); *A41D 2300/324* (2013.01); *A41D 2300/332* (2013.01); *A41D 2500/30* (2013.01)

(58) Field of Classification Search

CPC ..... A62B 23/02; A62B 17/04; A62B 18/02; A41D 31/30; A41D 13/02; A41D 13/1153; A41D 2300/32; A41D 2300/322; A41D 2300/324; A41D 13/1218

See application file for complete search history.

(56) References Cited

U.S. PATENT DOCUMENTS 3,413,972 A * 12/1968 Depping ..... A62B 18/045 128/201.23
3,432,860 A * 3/1969 Durney ..... B64G 6/00 285/314
3,529,594 A * 9/1970 Charnley ..... A62B 17/006 2/457
4,552,140 A * 11/1985 Cowley ..... A62B 17/04 128/205.28
4,683,880 A * 8/1987 Werjefelt ..... A62B 15/00 128/201.28
4,845,779 A * 7/1989 Wheeler ..... A42B 1/046 2/84
4,889,113 A * 12/1989 Pelloux-Gervais .... A62B 17/04 128/205.12
4,901,370 A * 2/1990 Suda ..... A62B 17/006 2/457
5,003,973 A * 4/1991 Ford ..... A62B 17/04 2/5
5,099,525 A * 3/1992 Millauro ..... A61F 9/029 128/857
5,226,409 A * 7/1993 Bower ..... A62B 17/04 128/201.23
5,253,642 A * 10/1993 Stackhouse ..... A42B 1/046 128/201.25
5,404,577 A * 4/1995 Zuckerman ..... H04R 1/46 455/66.1
5,452,712 A * 9/1995 Richardson ..... A62B 17/04 128/201.28
5,467,765 A * 11/1995 Maturaporn ..... A62B 23/025 128/206.13
5,819,728 A * 10/1998 Ritchie ..... A61M 16/06 128/201.25
6,134,716 A * 10/2000 Richardson ..... A41D 13/1153 2/202
6,460,538 B1 * 10/2002 Kemp ..... A62B 17/04 128/201.29
6,701,920 B1 * 3/2004 Cox ..... A62B 17/04 2/6.2
6,854,459 B1 * 2/2005 Cox ..... A62B 17/04 2/205
9,931,482 B2 * 4/2018 Ritchie ..... A41D 13/0005
10,449,397 B2 * 10/2019 VanDerWoude ..... A62B 7/00
11,202,925 B1 * 12/2021 Awad ..... A62B 7/10
2003/0075174 A1 * 4/2003 Shahaf ..... A62B 17/04 128/201.25
2003/0135915 A1 * 7/2003 Luppi ..... A62B 17/04 2/424
2006/0137686 A1 * 6/2006 Macris ..... A61M 16/107 128/201.22
2008/0105255 A1 * 5/2008 Resnick ..... A62B 18/04 128/201.22
2012/0036622 A1 * 2/2012 Carron ..... A62B 9/02 2/457
2012/0066819 A1 * 3/2012 Carron ..... A62B 17/04 2/456
2014/0184407 A1 * 7/2014 Patil ..... H04B 1/385 340/539.11
2015/0004131 A1 * 1/2015 Milstein ..... G21F 3/025 250/516.1
2015/0273248 A1 * 10/2015 Kuutti ..... A62B 18/02 128/201.12
2015/0375019 A1 * 12/2015 VanDerWoude ..... A62B 18/082 128/201.29
2016/0008640 A1 * 1/2016 Teetzel ..... A42B 3/228 128/201.19
2016/0030774 A1 * 2/2016 Graziani ..... A62B 18/04 128/201.25
2016/0030776 A1 * 2/2016 Rolland ..... A41D 13/1184 128/205.26
2016/0165973 A1 * 6/2016 Yazdi ..... A41D 13/02 2/457
2017/0137686 A1 * 5/2017 Klamklang ..... C04B 35/6316
2018/0014597 A1 * 1/2018 Cooke ..... H04R 1/028
2019/0111288 A1 * 4/2019 Isham ..... A41D 13/1184
2019/0231005 A1 * 8/2019 Jefferis ..... A42B 3/225
2020/0206544 A1 * 7/2020 Vaughan ..... A62B 17/04
2020/0275724 A1 * 9/2020 Jefferis ..... A42B 3/28
2020/0375272 A1 * 12/2020 Ulmer ..... A41D 1/005
2021/0001158 A1 * 1/2021 Ishikawa ..... A62B 18/084
2021/0331003 A1 * 10/2021 Thompson ..... A62B 18/084

* cited by examiner 140
142a
144
142b
144a
142c
154
142d
146a
142e
142f
146b
146c
152 user interface
150

PPE WITH ROTATING ASSEMBLY PROVIDING MULTIPLE FACE COVERS

CROSS REFERENCE TO RELATED APPLICATIONS

This application is a continuation in part of U.S. patent application Ser. No. 17/352,340, filed Jun. 20, 2021, application Ser. No. 17/352,340 was a continuation in part of U.S. patent application Ser. No. 17/093,213, filed Nov. 9, 2020, now U.S. Pat. No. 11,065,480, issued Jul. 20, 2021; the entire contents of these applications are incorporated herein by reference.

BACKGROUND OF THE INVENTION

Field of the Invention

This invention is in the field of personal protective equipment for infectious diseases such as airborne viruses.

Description of the Related Art

With the recent worldwide COVID-19 pandemic, there has been intense interest in personal protective equipment. Although the prior art contains numerous examples of various types of biohazard suits, such suits tend to be uncomfortable for prolonged periods. Thus, alternative personal protective equipment (PPE) designs that are more comfortable to wear are desirable.

BRIEF SUMMARY OF THE INVENTION

The invention was inspired, in part, by the insight that prior art facemasks and biohazard suits, at least with regards to the face mask portion, tend to be "one size fits all." However, in addition to differences in height and weight, different users also have quite differing facial structures. The length and width of the human face can vary. This variation can include differences in the size and position of the nose, mouth, and eyes. The structures of the forehead size, jaw size, and other features can also differ. Additionally, some users wear glasses (which themselves can have varying sizes and shapes), and some do not.

Another problem is that prior art facemasks generally bind tightly to various regions of the user's face, causing discomfort on prolonged use. Face shields, on the other hand, tend to trap moisture in the user's breath, leading to fogging and excess condensation.

The invention was also inspired, in part, by the insight that what is needed is an improved biohazard suit type PPE that allows a user to switch between different face shield designs rapidly. According to the invention, if the user is wearing glasses, the user may rapidly configure the PPE device to a face mask side to minimize fogging. If the user has a face with unusual contours, the user may wish to use a face mask side configured to provide ample room. If the user intends to eat or drink, the user may wish to use a face mask side configured to open and shut again as desired.

Thus, as will be discussed, in some embodiments, the invention comprises a PPE device configured with a rotating face cover assembly with a plurality of mask sides. These different mask sides can be configured for different user faces or other use cases. This rotating face cover assembly can be further configured to attach to a zip-up bodysuit that covers the user's entire body, enabling the user to avoid contamination while exposed to airborne infectious agents such as bacteria and viruses. However, by rotating the rotating face cover assembly, the user can rapidly select the mask side best optimized for a given user.

Embodiments that enable the device to be more comfortable, convenient, and have improved user protection in difficult environments are also discussed.

BRIEF DESCRIPTION OF THE DRAWINGS

FIG. 5A shows a line drawing of a portion of the rotating face cover assembly showing the top, circular base, circular collar, and two different mask sides.

FIG. 5B shows an exploded diagram of the drawing of FIG. 5A.

DETAILED DESCRIPTION OF THE INVENTION

Figure 1:
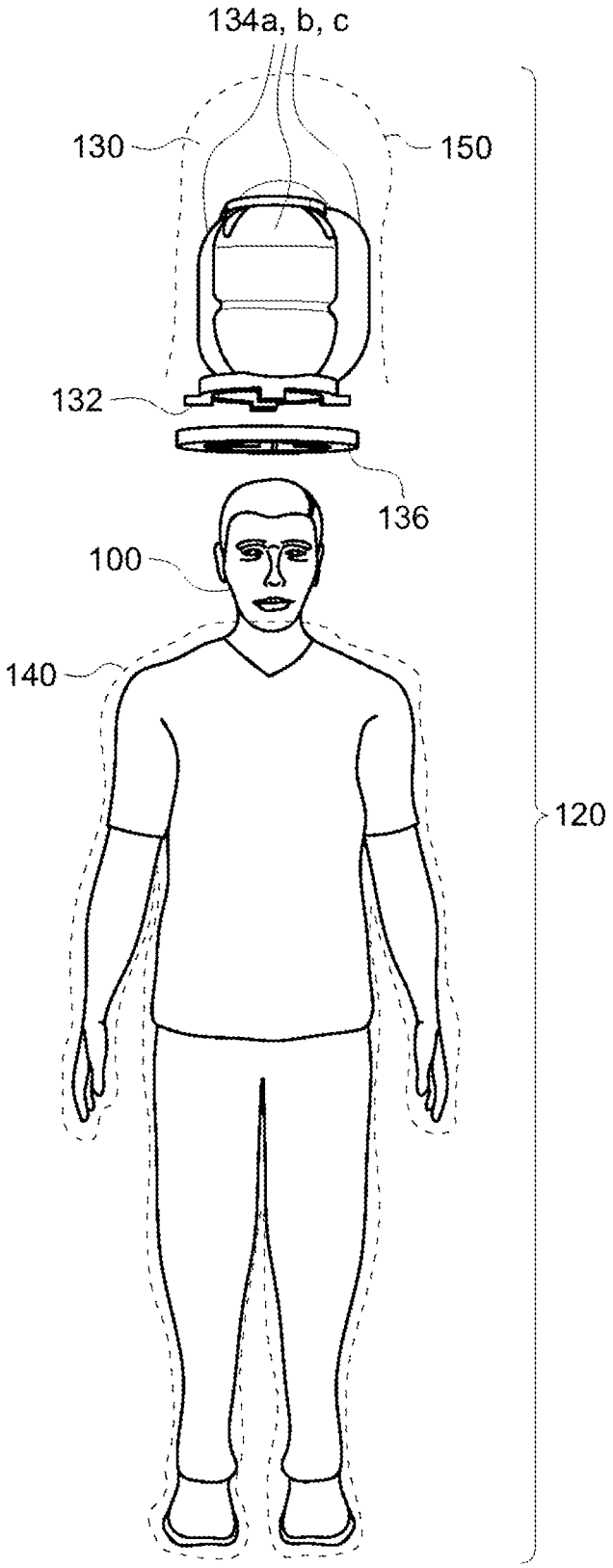
FIG. 1 shows an exploded drawing of a user wearing the invention's PPE device.

FIG. 1 shows an exploded drawing of a user (100) wearing a PPE device (120). This device comprises a rotating face cover assembly (130) with a circular base (132), and a plurality of mask sides (134*a, b, c*). The rotating face cover assembly (130) can be reversibly attached and detached to a circular collar (136). In some embodiments, the bodysuit side of this circular collar will further comprise an optional ergonomic gasket (136*c*) configured to conform to the shape of the user's shoulders. This ergonomic gasket may be made from a deformable material such as foam as desired, and may improve the comfort of the system when worn for long periods.

This circular collar is attached to a zip-up bodysuit (140). In use, the user (100) puts on the bodysuit (140), zips up the zippers (see FIG. 6A and FIG. 6B), and then attaches the rotating face cover assembly (130). In some embodiments, the user may also affix an optional hood (150) on top of the rotating face cover assembly (130). This hood (150) may often also be attached to the bodysuit (140). See FIG. 6C for more detail.

The body may generally comprise a microbial impermeable fabric, non-woven fabric, or plastic material formed from nylon or other type of synthetic polymer.

Thus, in some embodiments, the invention is a PPE device (120) configured for different types of human users. In addition to differences in their height, weight, these different types of users may also differ in the position or dimensions of their nose, mouth, or eye regions of their faces.

Figure 2A:
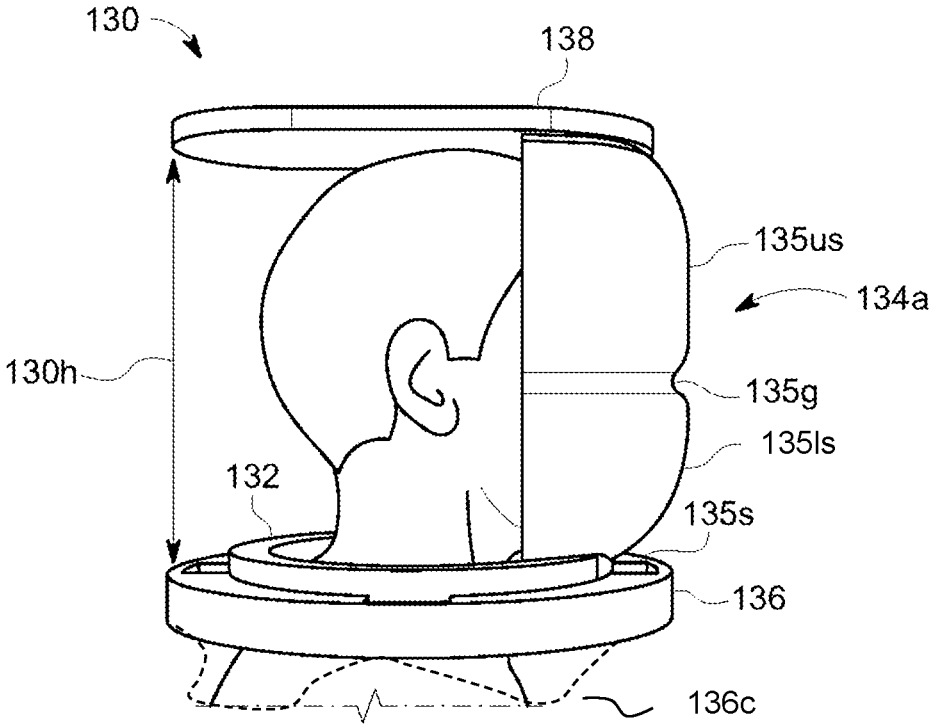
FIG. 2A shows a detail of the rotating face cover assembly.
Figure 2B:
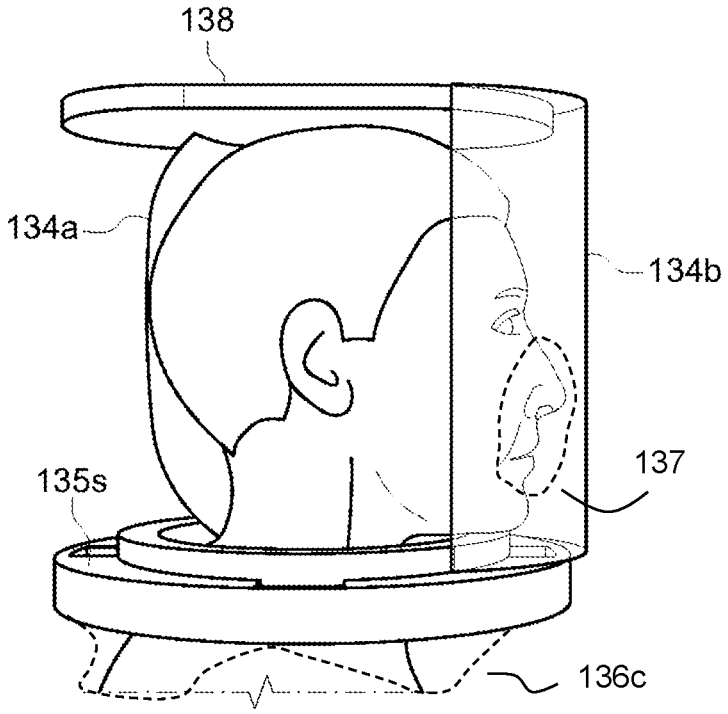
FIG. 2B shows another detail of the rotating face cover assembly.

As previously discussed, and as shown in more detail in FIG. 2A and FIG. 2B, this PPE device will typically comprise a rotating face cover assembly with a circular base (132), a height (130*h*), a plurality of mask sides (134*a*, 134*b*), and a mask top (138), the assembly configured to fit over different types of user's heads and attach to a circular collar (136) in at least one orientation;

Here, the plurality of mask sides (134*a*, 134*b*, 134*c*) are disposed between the circular base (132) and the mask top (138); and are connected to their neighboring mask sides, the circular base (132), and the mask top (138) to form a continuous covering surrounding all sides and head top of different types of user's heads;

In some embodiments, the circular base (132) and the circular collar (136) are configured with an adjustable mechanism enabling different mask sides to be positioned in front of the face of the users.

This adjustable mechanism can be various slots and tabs (135*s*) in the circular base (132) and circular collar (136) that enables the assembly (130) to fit into the circular base at various defined orientations, a sliding mechanism, or other types of mechanism. Here for simplicity, the multiple slots and tabs are shown, positioned at 90-degree angles on the circular base and circular collar. Although in this embodiment four slots/latches (135*s*) and corresponding tabs or latches are shown, this is not intended to be limiting. In other embodiments a smaller (e.g., 3) or larger (e.g., 5) number of slots/latches may be used.

In other embodiments, other attachment mechanisms, including zippers, hook and loop fasteners (e.g., Velcro), pressure fasteners, screw thread mechanisms, and other attachment mechanisms may be used.

In some embodiments, each mask side (134*a*, 134*b*, 134*c*) may be configured with a microbial filter element, a transparent element (which form the outline of the mask side itself), and various mask side supporting elements (135*e*) that are configured to shape portions of the surface of the mask side so that, when a user wears the mask, the surface of the mask side does not contact a nose, mouth, or eyes of at least one type of user.

The transparent element can be formed from any suitably microbial impermeable transparent material, including polycarbonate or Polyethylene terephthalate glycol (PETG) plastic or other type plastic, or various glass and glass-like materials including borosilicate glass, transparent aluminum oxide $Al_2O_3$ (often called sapphire glass), as well as various proprietary and chemically strengthened glass materials such as alkali-aluminosilicate sheet glass, sometimes called Gorilla Glass. Although the transparent element will often be impermeable to air, this is not always the case. As will be discussed, in some embodiments, the transparent element can also serve as an air filtration element and be at least somewhat permeable to air.

In some embodiments, each different mask side (e.g., 134*a*, 134*b*) may have different mask side supporting elements (135*e*). These enable a first mask side, such as 134*a*, to be optimized to maintain a first set of distances between the mask side and the nose, mouth, or eyes of a first type of human user. Similarly, a different mask side, such as 134*b*, may be optimized to maintain a different set of distances between this other mask side and the nose, mouth, or eyes of a different human user. This allows different users to select among different mask sides (e.g., 134*a*, 134*b*, 134*c*, etc.) that are most comfortable for each user's head geometry, eyewear, or use situation.

FIG. 2A shows a detail of the rotating face cover assembly (130). Although this face cover assembly comprises a plurality of different mask sides typically, in FIG. 2A, only one mask side (134*a*, here shown opaque, although the mask sides are usually transparent) is shown covering the front of the user's face. This mask side has an indented groove (135*g*) positioned above the user's mouth and nose and below the user's eyes. It is intended to act as a partial barrier to help prevent moist air from the user's breath from fogging the user's vision.

In some embodiments, either in place of this indented groove, or to supplement this indented groove, foam or other soft material may be used at (135*g*), approximately at the level of the user's nose bridge, to help prevent moist air from the user's nose and mouth area from rising and condensing in the eye region.

FIG. 2A also shows more details of the mask top (138). In some embodiments, this mask top may comprise an air-permeable microbial filter so that the user may obtain at least some outside air through the mask top (138).

In some embodiments, the mask sides may comprise a transparent air-impermeable portion and a non-transparent air-permeable microbial filter. For example, in FIG. 2A, the upper side (135*us*) of the mask (134*a*) may be transparent, while the lower side (1341*s*) of mask 134*a* may comprise an air-permeable microbial filter. In other embodiments, both the upper side and the lower side may include a transparent air-permeable microbial filter.

Various materials may be used for the transparent air-impermeable portion of the mask, including polycarbonate, cellophane, borosilicate, PETG plastic, Sapphire glass, and Gorilla glass (Gorilla glass is a trademark of Corning Corporation). Generally, polycarbonate, cellophane, or other transparent plastic materials are lower cost and easier to use in manufacturing. However, glass materials may be used as needed.

For example, in some embodiments, such as when it is anticipated that the users may be working in environments with high levels of ultraviolet (UV) light, it may be useful to employ transparent materials or coatings that block a significant portion of the ambient UV light, such as blocking 50%, 90% or more of the ambient UV light. This can be done by, for example, configuring at least one mask side with transparent elements that further comprise a material or coating that blocks ultraviolet light. Suitable materials can include polycarbonate as well as certain types of glasses.

Further, in some embodiments, it may be anticipated that some uses may be exposed to sparks, hot oil droplets, or other high temperature particles. In such cases it may be further useful to form at least the transparent elements on at least one side of the mask from high melting point materials that are substantially impervious to damage from hot oil droplets, at least hot oil droplets at temperatures less than 200 degrees centigrade. Here use of glass materials, which can generally stand up to high temperatures of over 1000 degrees centigrade, may be preferred.

For example, the non-transparent air-permeable microbial filter (135*ls*) may comprise spunbond-meltblown polypropylene. In situations where both mask sides (135*us* and 135*ls*) include a transparent, air-permeable microbial filter, this transparent air-permeable microbial filter may comprise at least one microporous layer.

Optional valve arrangements: In some embodiments, the non-transparent air-permeable microbial filters may be supplemented or replaced by one or more breathing valves. These breathing valves are essentially one-way flaps with optional air filters on the openings. These valves open and close when the user's breathing creates a pressure gradient across the valve. Thus, these valves may admit filtered outside air when the user inhales. Alternatively, the valves may expel user exhaled air to the outside.

In some embodiments, there may be a first valve that opens when the user inhales, and a second valve that opens when the user exhales. In some embodiments, outside air may pass through one or more filters to remove microbial contaminants. Here, air pumps, such as electrical air pumps, may also be used (sometimes as a part of the suit) to help provide adequate airflow without overly tiring the user.

In some alternative embodiments, external air supplies, such as back mounted compressed air or oxygen cylinders, may also be used. Alternatively, air may be supplied by external air compressors, and delivered by flexible tubing. These embodiments will be discussed in more detail later in this disclosure.

FIG. 2B shows another detail of the rotating face cover assembly (130). In this orientation, the previous indented mask (134*a*) side previously shown in FIG. 2A is turned away from the user's face, and here the user is now facing a different mask side (134*b*) that is not indented. Note that this mask side is also not contacting the user's mouth, nose, or eyes.

In some embodiments, the user may also wear an optional inner face-mask (137) as a secondary protection against any leaks, as well as to help prevent moisture from the user's breath from fogging the transparent eye covering. In some embodiments, this inner face mask may itself comprise an air purifier.

Figure 3A:
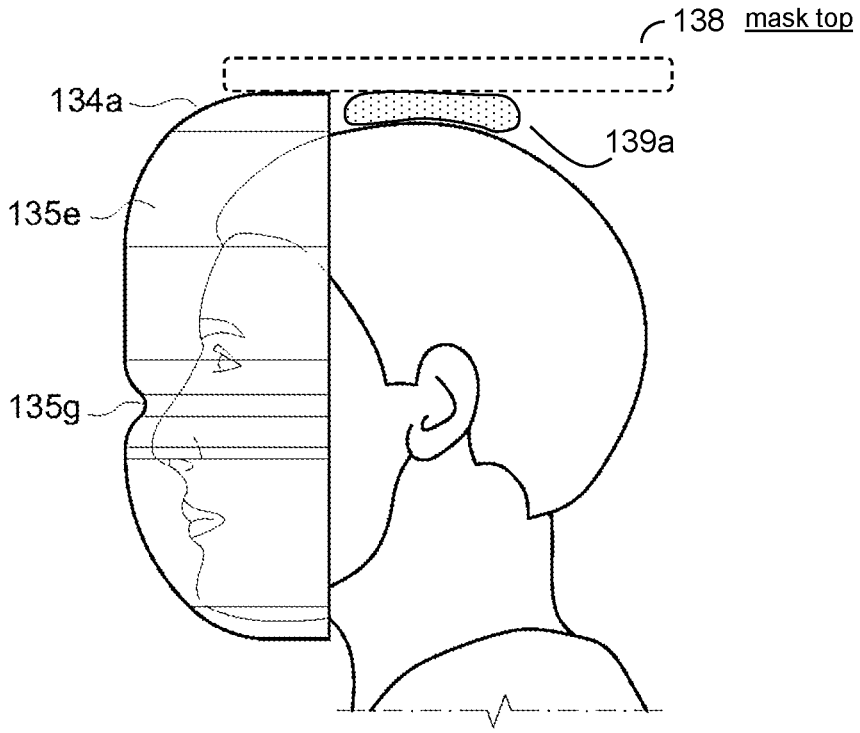
FIG. 3A shows a detail of the indented mask side previously shown in FIG. 2A, with all other elements of the PPE device not shown.

FIG. 3A shows a detail of the indented mask side (134*a*) previously shown in FIG. 2A, with all other elements of the PPE device not shown. This clearly shows how the indented groove (135*g*) is positioned between the user's nose and eyes. It also shows that even the indented mask side (134*a*) does not contact the user's mouth, nose, or eyes. Here the supporting elements (135*e*) may comprise deformation-resistant wires or deformation resistant (e.g., rigid) plastic supports. An optional cushioning pad (139*a*) under mask top (138), discussed below, is also shown.

Figure 3B:
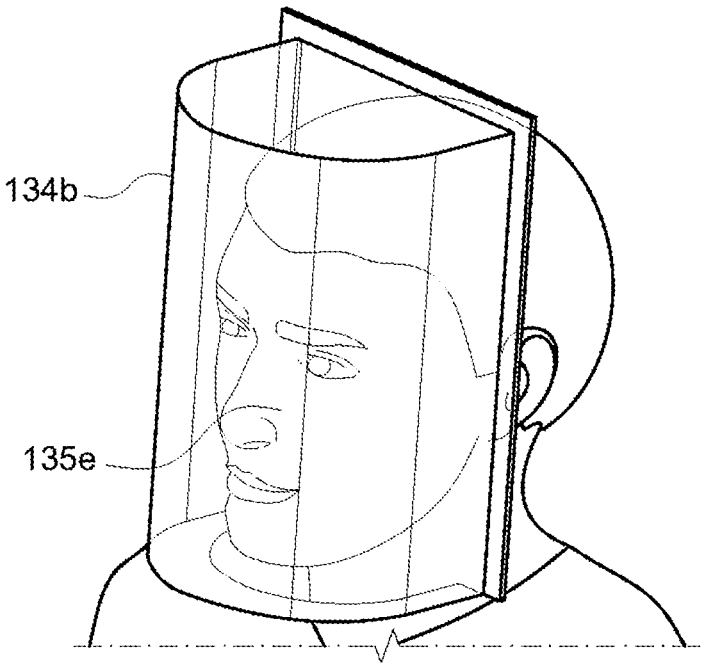
FIG. 3B shows a detail of the different mask side previously shown in FIG. 2B.

FIG. 3B shows a detail of the different mask side (134*b*) previously shown in FIG. 2B. This mask side may also have support elements (135*e*), but they are arranged in a different configuration from those shown in FIG. 3A.

Figure 4A:
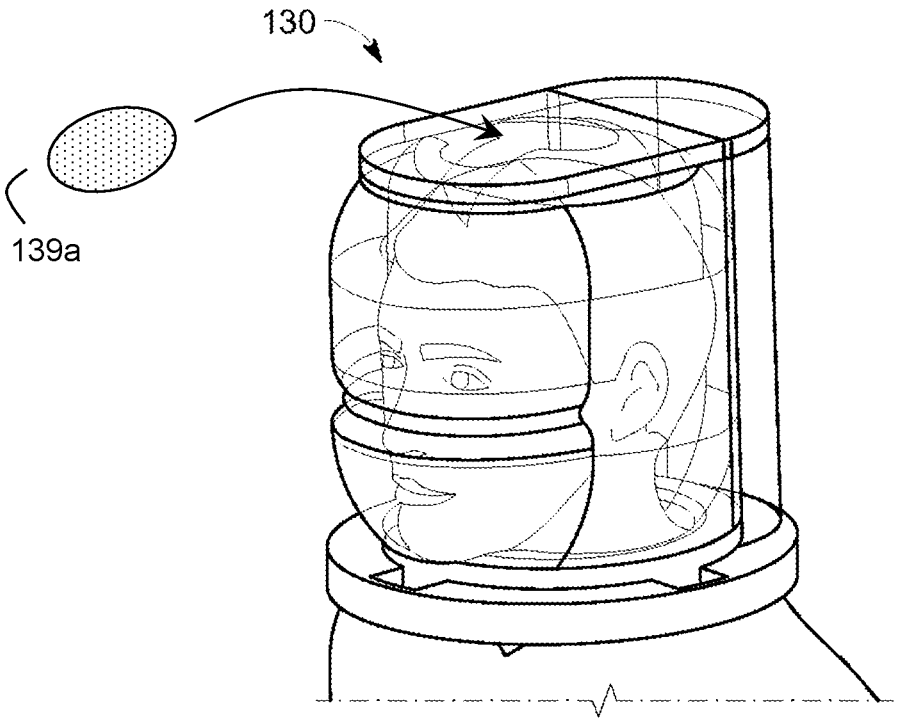
FIG. 4A shows further details of the rotating face cover assembly as the user wears it, showing how one device can comprise a plurality of mask sides.

FIG. 4A shows further details of the rotating face cover assembly (130) as the user wears it, showing how one device can comprise a plurality of mask sides. As previously discussed, the user can rotate the rotating face cover assembly to switch between different mask sides as desired. In some embodiments, an optional cushioning pad (139*a*) may be placed on the inner side of the mask top (138) between the mask top and the top of the user's head to help support some of the weight of the rotating face cover-assembly. This cushioning pad is also shown in FIG. 3A. This cushioning pad may come in various dimensions to better fit different users, or may comprise compressible foam or spring elements to fit different user head heights above the user's shoulders.

Figure 4B:
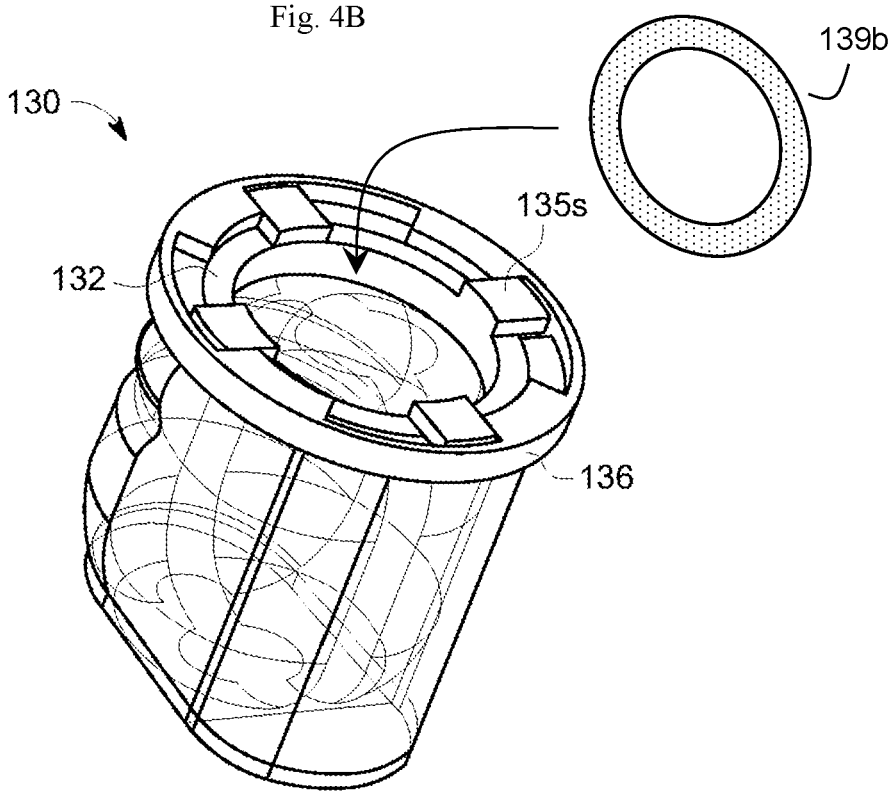
FIG. 4B shows the rotating face cover assembly as seen from the bottom, showing how the circular base can fit into the circular collar (note that the circular collar is normally mounted on the bodysuit, but here is shown by itself for clarity).

FIG. 4B shows the rotating face cover assembly from the bottom, showing how the circular base (132) can fit into the circular collar (136). Note that the circular collar (136) is typically attached to the bodysuit (140), but in FIG. 4B is shown by itself for greater clarity. In some embodiments, an additional foam collar (139*b*) may also be added for better comfort and to improve the fit between the face cover assembly, the user, and the bodysuit.

In some embodiments, the plurality of mask sides can comprise at least three mask sides (such as 134*a*, 134*b*, 134*c*, etc.), and these three mask sides are disposed along different arc segments of the circular base (132). As previously discussed, this circular base (132) is configured to attach to the circular collar (136) at any of at least three different orientations. Typically, these at least three different orientations are spaced evenly apart along the circular base and circular collar. Alternatively, the circular base (132) can to attach to the circular collar (136) at one orientation. The base can then rotate about the circular collar to position the desired mask side in front of the user's face.

Figure 4C:
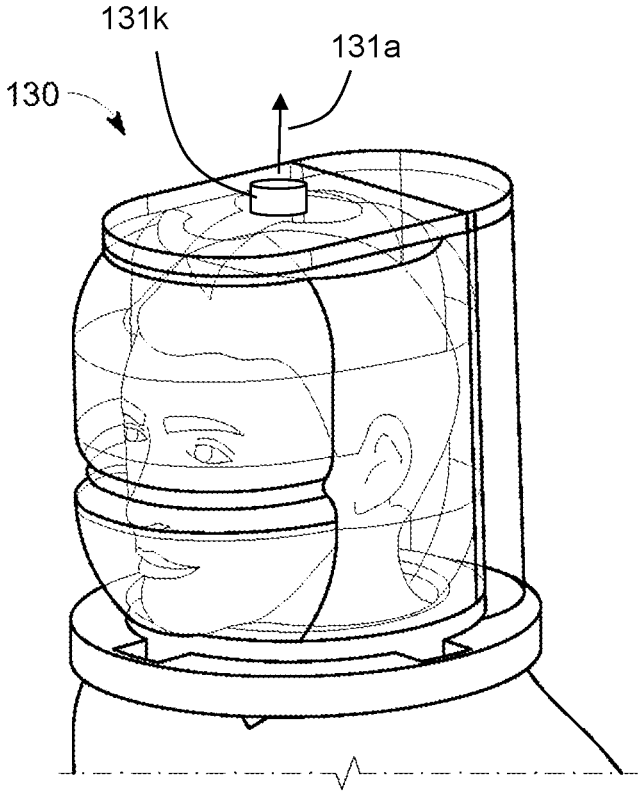
FIG. 4C shows further details of an optional rotational control device.

FIG. 4C shows an embodiment that further comprises a rotation control device (131*k*), such as a knob disposed on the mask top. This rotation control device is configured to provide an axis of rotation (131*a*) for the various mask sides. In this embodiment, the rotation control device (131*k*) is further configured to transmit torque, such as mechanical torque applied by a human (such as the user) to the various mask sides, thus causing the various mask sides to rotate around the axis of rotation (131*a*). In some embodiments, this rotation control device (131*k*) can alternatively comprise an electric motor, which instead can apply torque to the various mask sides in response to a signal.

Figure 4D:
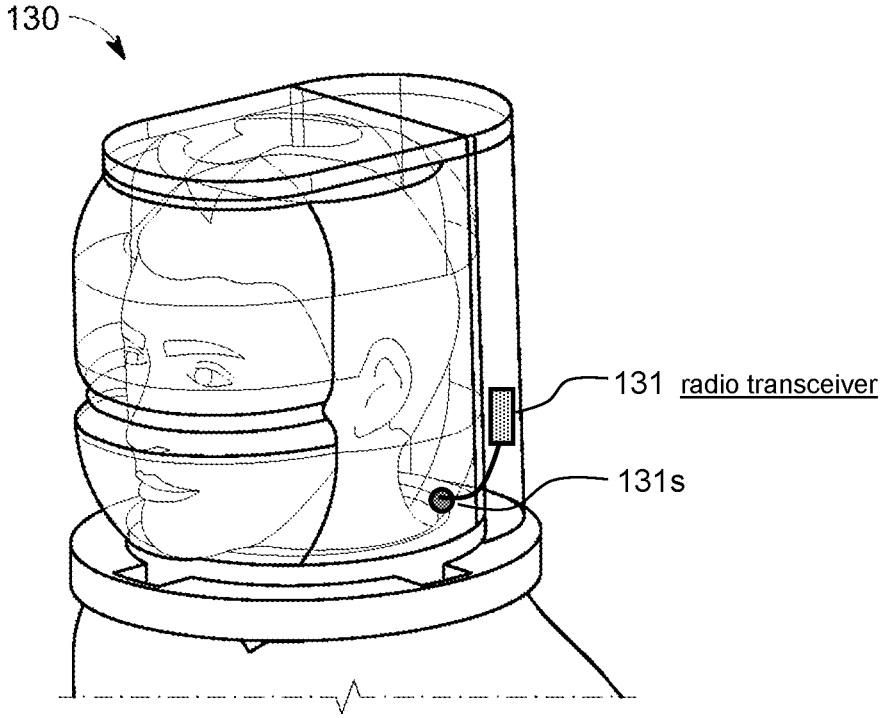
FIG. 4D shows an optional radio transceiver and sensor arrangement.

FIG. 4D shows further details of an optional radio transceiver (131*t*) and one or more sensors (131*s*), which in some embodiments may be also mounted in the rotating face cover assembly.

This radio transceiver may (131*t*), may for example, comprise a short-range radio transceiver such as a Wi-Fi or Bluetooth transceiver. The one or more sensors (131*s*) may comprise sensors configured to sample either the environment of the wearer inside the suit, such as temperature, humidity, carbon dioxide, etc., or alternatively or additionally also sample the outside environment outside of the suit. The results of these sensor measurements may be transmitted by the transmitter to one or more locations, including suit mounted displays, or other data recording and playback systems as desired.

FIG. 5A shows a line drawing of a portion of the rotating face cover assembly showing the top, circular base, circular collar, and two different mask sides.

FIG. 5B shows an exploded diagram of the drawing of FIG. 5A. In some embodiments, the mask sides may be permanently affixed to the top and circular base. However, in other embodiments, one or more mask sides may be removable. They may be attached or detached from the top, circular base, and the adjacent mask sides by any of buttons, snaps, zippers, or hook-and-loop fasteners. Here snaps (135*f*) are shown.

Note that in some embodiments, at least one of the mask sides may be detachable mask sides. These detachable mask sides may be configured to be attached and detached from the rotating face cover assembly (130) through any of snaps (135*f*), buttons, zippers, or hook-and-loop fasteners. In some cases, the face mask side may be semi-detachable, such as detachable from the circular base, but not detachable from the mask top. Instead, the mask side may be attached to the mask top via a hinge (135*h*), so that the mask side may be temporarily raised for the user to eat or drink (160). This mask side can then be closed when the user has finished eating or drinking. Thus, in this embodiment, at least one mask may be configured to be raised and lowered in a "visor style" fashion.

In some embodiments, to help prevent the face cover assembly from wobbling due to rapid motion or accidental knocks, additional straps may be used to help affix the face cover assembly (130) to the bodysuit (140). Many alternative strap arrangements are possible.

FIG. 5A (135*h*) shows this optional flexible hinge (FIG. 5A, 135*h*) connecting the mask side with the mask top. This hinge, along with a detachable connection with the circular base (such as lower snaps 135*f*), can enable this at least one mask side to temporarily swing away (160) from the circular base and be raised and then lowered and reattached by the user.

In most embodiments, the PPE device (120) is configured so that a first type of human user can adjust a first mask side (such as 134*a*) in front of the first type of human user's face. A different type of human user can adjust a different mask side (such as 134*b*) in front of the different type of human user's face. As previously discussed, the circular collar (136) is attached to a zip-up bodysuit (140). This bodysuit (140) is configured to fit over the user's body. This zip-up bodysuit is typically comprised of microbial impermeable materials (such as a biohazard compatible fabric) to further protect the user from microbial contamination, such as viral contamination, from virus sources outside the user's body.

Figures 6A, 6B, 6C:
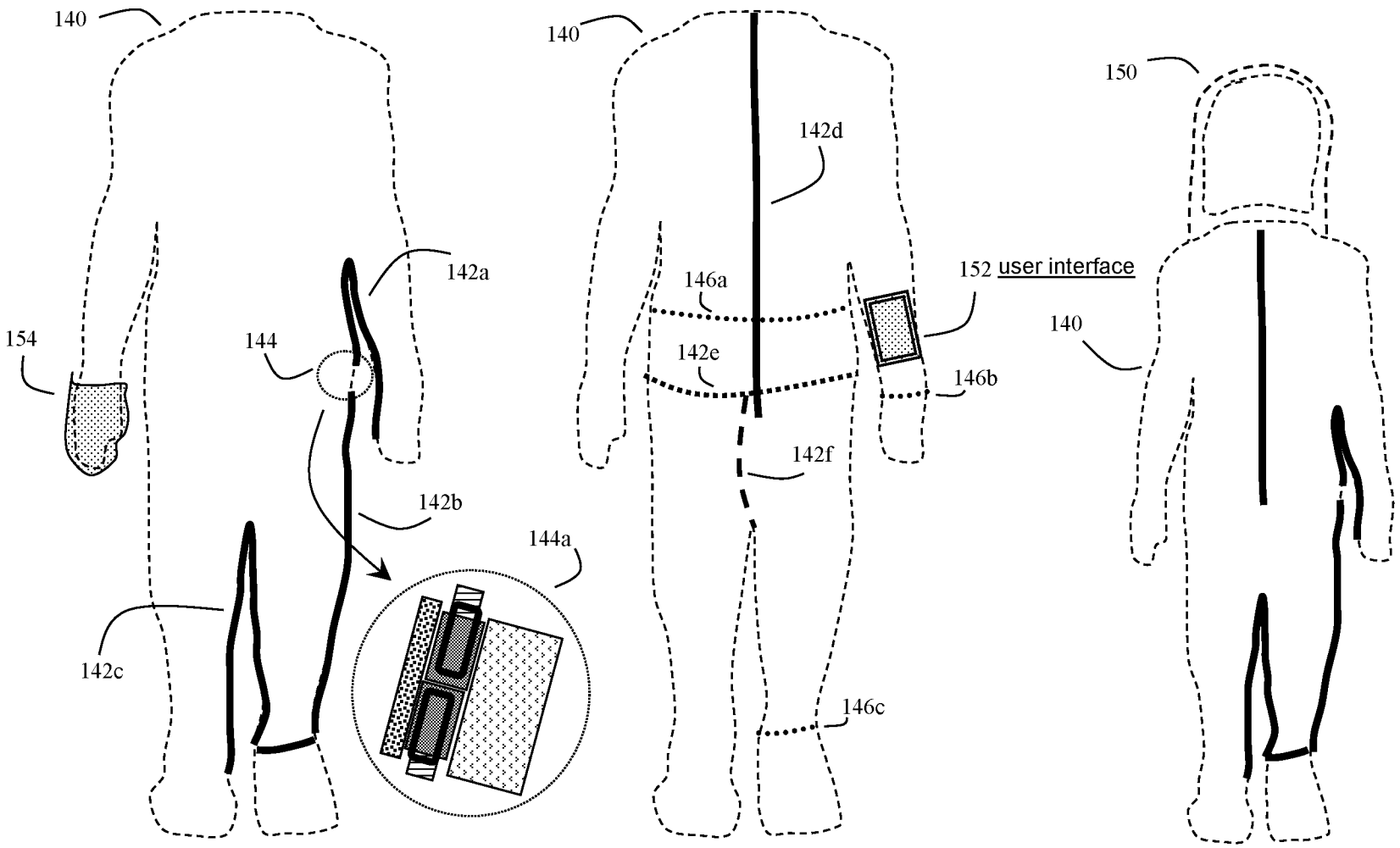
FIG. 6A shows one embodiment of the zip-up bodysuit, in which the bodysuit comprises a plurality of side-mounted zippers that, together, extend from the user's wrist to the user's waist, from the waist to the user's ankle, and from this ankle, across the crouch, and onto the other ankle.
FIG. 6B shows another embodiment of the zip-up bodysuit. Here the bodysuit comprises a front-mounted zipper that extends from the user's waist to the circular collar. Again, the optional hood attachment is not shown.
FIG. 6C shows another embodiment of the zip-up bodysuit, here also showing the optional hood that can be configured, regardless of zipper configuration, to extend over the top of the rotating face cover assembly.

FIG. 6A shows one embodiment of the zip-up bodysuit (140), in which the bodysuit comprises a plurality of side-mounted zippers (142*a*, 142*b*, 142*c*). These zippers, together, extend from the user's wrist to the user's waist (142*a*), and from the user's waist to the user's ankle (142*b*), and from this ankle, across the user's crotch, and onto the user's other ankle (142*c*). Here the optional hood attachment is not shown.

Note that in regions where two zippers join, such as (144), where (142*a* and 142*b*), there may be a need to ensure that the two zippers remain shut and do not leak. This joint region (144) is shown magnified in (144*a*). Here the two zipper heads may be held closed by magnetic clasps or by hook and loop fasteners, such as Velcro® fasteners (144*b*).

Put alternatively, as shown in FIG. 6A, the zip-up bodysuit can comprise a plurality of side-mounted zippers. These zippers can be configured to extend from the wrist of the user to the waist of the user. Then from the waist to the first ankle of the user. The zipper extends from this first ankle to the user's crotch, and finally from the crotch to another ankle. Alternatively, the zip-up bodysuit can comprise a side-mounted zipper configured to extend from the wrist of the user to an ankle of the user.

FIG. 6A also shows another embodiment where the body suit may comprise one or more optional gloves (154). These gloves may be configured with materials that are selected to be more resistant to abrasion, chemical solvents, or extreme temperatures. For example, the gloves may be configured of a heat and solvent resistant material selected to be resistant to damage from hot oil droplets, such as oil droplets with temperatures of 200 degrees centigrade or below. Suitable materials for such gloves include neoprene, silicone, fiberglass fabric, and aramid (aromatic polyamide) fabrics.

FIG. 6B shows another embodiment of the zip-up bodysuit. Here the bodysuit comprises a front-mounted zipper (142*d*) that extends from the user's waist to the circular collar. Again, the optional hood attachment is not shown. In other words, in this configuration, the zip-up bodysuit comprises a front-mounted zipper (142*d*) disposed from the circular collar to a crotch of the user. Alternatively, the bodysuit may be a two-piece bodysuit, with a zipper (142*e*) that extends around the waist, separating the bodysuit into an upper half or a lower half. This zipper (142*e*) may also be optionally covered by a belt or waistband, such as a 2-3-inch-wide belt or waistband, as desired. As another embodiment, the bodysuit may have a crotch zipper (142*f*) that allows the crotch area to be completely unzipped for waste removal (sanatory) purposes.

In some embodiments, the bodysuit may additionally contain tighteners, such as drawstrings or elastic bands (146*a*, 146*b*, 146*c*) or other elastomeric material to make the waist (146*a*), wrists (146*b*), and ankles (146*c*) of the bodysuit fit more snugly around the corresponding parts of the user. Additionally, in some embodiments, the bodysuit may be treated with fabric protectors, such as suitable water repellants, to help reduce the risk of microbial laden water droplets from adhering to the bodysuit, or penetrating through the bodysuit.

In some embodiments, the bodysuit may also comprise an arm-mounted user interface (152). This arm-mounted user interface can comprise, for example, a tablet computer with at least one processor, and a graphical user interface such as a touchscreen. This user interface may be used for a variety of different purposes. For example, in those embodiments where the system also has a motorized rotation control device, such as (131*k*), the user interface may be configured to control the operation of this motorized rotational control device, either directly, or by a intermediary transceiver arrangement such as by way of transceiver (131*t*). In other embodiments, such as when the system has various sensors (131*s*), the arm mounted user interface may be configured to display the results from these sensors, as well as other data.

FIG. 6C shows another embodiment of the zip-up bodysuit, here also showing the optional hood that (150) can be configured, regardless of zipper configuration, to extend over the top of the rotating face cover assembly and extend to the suit (140). Put alternatively, in some embodiments, the zip-up bodysuit (140) can comprise a hood element (150 configured to attach to or cover the mask top (138). Although this hood element (150) may be attachable and detachable from the bodysuit (140), in some embodiments, this hood (150) may be permanently attached to the zip-up bodysuit (140). This hood (150) may also have an optional visor as desired.

In still other embodiments, a partially detachable mask may be attached to a hook, button, clasp, or other attachment mechanism that is attached on a hood, so that the detachable may be removed for eating or drinking, yet remain attached to the hood so that the detachable mask will need not be lost.

Supplemental Breathing Equipment

As previously discussed, although, in many embodiments, the user will obtain air through one or more microbial filter elements embedded in the sides of the mask, other embodiments are also possible.

In some embodiments, the bodysuit may be configured with carrying straps to carry one or more air or oxygen tanks. These air or oxygen tanks can be affixed to the bodysuit (for example on the back), and be configured to supply air or oxygen to the mask by way of suitable connecting tubes, valves, and optional air flow regulators.

Figure 7A:
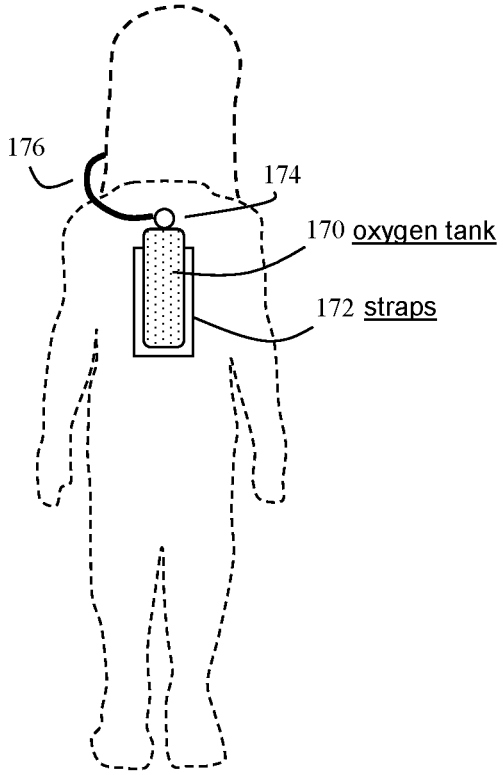
FIG. 7A shows an embodiment with an optional, back-mounted, air or oxygen tank configured to provide air to the user while the user is being decontaminated with toxic chemicals.

FIG. 7A shows an embodiment with an optional, back-mounted, air or oxygen tank (170) configured to provide air to the user while the user is being decontaminated with toxic chemicals. This tank may be supported by suit-attached straps or other tank-mounting fixtures (172), and may additionally supply air to the mask by way of one or more valves (174) and tubes or hoses (176).

These tanks can provide supplemental air that the user may draw upon during a decontamination process. Often, the most effective decontamination chemicals are chemicals that are toxic to humans. However, after leaving a highly contaminated environment, it may be occasionally be desirable instruct the user to close off access to the outside air (e.g., close any access port connecting the filter elements to the outside air), turn on valves connecting the mask with the air or oxygen mask, and then decontaminate the bodysuit with sterilizing agents. This way, the user inside the suit can be protected from such harsh sterilizing chemicals (which might otherwise penetrate a standard microbial filter), and receive adequate air during the duration of the sterilizing process.

Put alternatively, in some embodiments, the bodysuit or mask can be further configured with air or oxygen tank straps or holders (172), and at least one hose (176), valve (170), and air or oxygen tank (170). These will be configured to allow the user to obtain air or oxygen from the tank for at least the duration of a brief chemical sterilization process. Normally the tank should be able to supply the average user with adequate air for at least five minutes. However, it may be desirable to use larger tanks that can operate for 10 minutes, 15 minutes, 30 minutes or even longer, as desired.

Similarly, although often the microbial filter elements embedded in the sides of the mask will generally be continually open to allow the passage of air, at least during use, other configurations are also desirable and possible. In some embodiments, access to the microbial filter elements may be controlled by the previously discussed flaps or valves, which may be user adjustable, so that such valves can be closed, restricting access to the outside environment, as desired. Such user-controlled flaps or valves can be particularly useful during a decontamination process that uses toxic chemical agents.

Figure 7B:
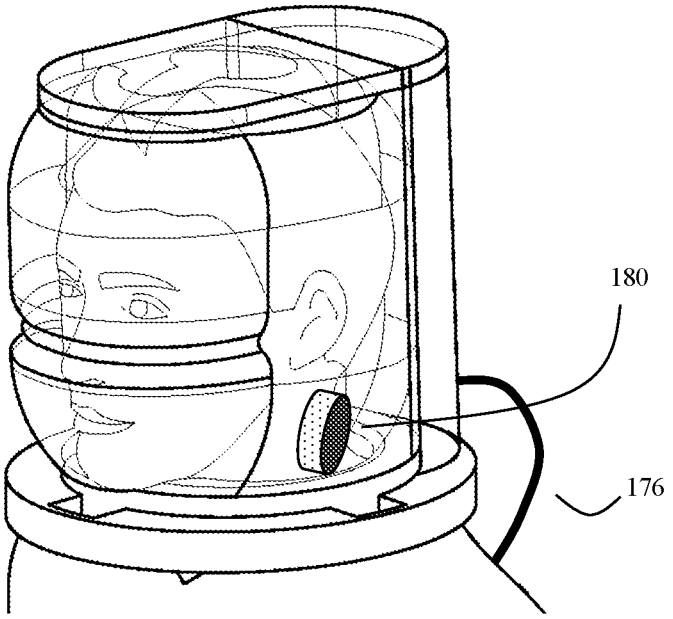
FIG. 7B shows an optional valve arrangement with internal flaps that can be used to control the flow outside air to the user, or control the flow of inside (suit) air from the user to the outside.

FIG. 7B shows an optional valve (180) arrangement with internal flaps that can be used to control the flow outside air to the user, or control the flow of inside (suit) air from the user to the outside.

Velcro® is a registered trademark of Velcro BVBA.

The invention claimed is:

1. A Personal Protective Equipment (PPE) device configured for different human users, said PPE device comprising:

a rotating face cover assembly with a circular base, a height, a plurality of mask sides, rotation control device, and a mask top, each mask side of the plurality of mask sides having a surface, said assembly configured to fit over different user's heads and attach to a circular collar in at least one orientation;

wherein said plurality of mask sides are disposed between said circular base and said mask top; and each of said plurality of mask sides is connected to their neighboring mask sides of the plurality of mask sides, said circular base, and said mask top so as to form a continuous covering surrounding all sides and head top of different user's heads;

said circular base and said circular collar configured with an adjustable mechanism enabling different mask sides of the plurality of mask sides to be positioned in front of a face of said different users;

each said mask side of the plurality of mask sides configured with a microbial filter element, a transparent element, and mask side supporting elements;

wherein each mask side of the plurality of mask sides has different mask side supporting elements so that a first mask side of the plurality of mask sides maintains a first set of distances between said first mask side and said nose, mouth, or eyes of a first human user, and so that a second mask side of the plurality of mask sides that is different from the first mask side maintains a second set of distances that are different from the first set of distances between said second mask side and said nose, mouth, or eyes of a different human user;

said PPE device configured so that a first human user is able to use said rotation control device to adjust the first mask side in front of said first human user's face, and a different human user is able to use said rotation control device to adjust said second mask side in front of said different human user's face;

said PPE device further configured with at a short-range radio transceiver and at least one sensor;

said circular collar attached to a zip-up body suit configured to fit over a body of said users, said zip-up body suit comprising microbial impermeable materials.

2. The device of claim 1, wherein said plurality of mask sides comprise at least three mask sides, and said at least three mask sides are disposed along different arc segments of said circular base.

3. The device of claim 2, wherein said circular base is configured to attach to said circular collar at any of at least three different orientations, said at least three different orientations are spaced evenly apart.

4. The device of claim 1, wherein said circular base is configured to attach to said circular collar at one orientation, and said circular base is configured to rotate about said circular collar.

5. The device of claim 1, wherein said circular base is configured to attach to said circular collar using zippers, hook and loop fasteners, pressure fasteners, or screw thread mechanisms.

6. The device of claim 1, wherein the transparent element comprises a transparent air impermeable portion, and the microbial filter element comprises a non-transparent air permeable microbial filter or a transparent, air-permeable microbial filter.

7. The device of claim 1, wherein said body suit comprises a microbial impermeable fabric, non-woven fabric, nylon, or a synthetic polymer.

8. The device of claim 1, wherein said transparent element comprises a polycarbonate, polyethylene terephthalate glycol, borosilicate, transparent aluminum oxide, or alkali-aluminosilicate material.

9. The device of claim 1, wherein said transparent element on at least one said mask side further comprises a material or coating that blocks ultraviolet light.

10. The device of claim 1, wherein said transparent element on at least one said mask side further comprises a high melting point material that is substantially impervious to damage from hot oil droplets at temperatures less than 200° C.

11. The device of claim 1, wherein said rotation control device is disposed on said mask top;

said rotation control device is configured to provide an axis of rotation for said plurality of mask sides; and said rotation control device is further configured to transmit torque from said rotation control device to said plurality of mask sides, thus causing said plurality of mask sides to rotate around said axis of rotation.

12. The device of claim 11, wherein said rotation control device is configured with a knob disposed on an outside of said mask top, and said knob configured to transfer manually applied torque, through said axis of rotation, to said plurality of mask sides.

13. The device of claim 11, wherein said rotation control device further comprises an electric motor, and said electric motor is configured to apply torque to said rotation control device.

14. The device of claim 13, wherein said zip-up body suit further comprises an arm mounted user interface configured to control at least said electric motor.

15. The device of claim 1, wherein said at least one sensor comprises a temperature sensor and/or a humidity sensor.

16. The device of claim 1, wherein said body suit comprises gloves, and wherein said gloves further comprise material that is resistant to damage from hot oil droplets at temperatures less than 200° C.

17. The device of claim 1, wherein said collar further comprises an ergonomic gasket configured to conform to a shape of said user's shoulders.

* * * * *